US007926753B2

(12) United States Patent
Carver

(10) Patent No.: US 7,926,753 B2
(45) Date of Patent: Apr. 19, 2011

(54) MATERIAL AND PACKAGING SHREDDING MACHINE

(75) Inventor: George Arthur Carver, Wabash, IN (US)

(73) Assignee: Martin Yale Industries, Inc., Wabash, IN (US)

( * ) Notice: Subject to any disclaimer, the term of this patent is extended or adjusted under 35 U.S.C. 154(b) by 79 days.

(21) Appl. No.: 12/410,573

(22) Filed: Mar. 25, 2009

(65) Prior Publication Data

US 2010/0243779 A1 Sep. 30, 2010

(51) Int. Cl.
*B02C 18/22* (2006.01)

(52) U.S. Cl. ..... 241/99; 241/224; 241/236

(58) Field of Classification Search ..... 241/280, 241/224, 222, 236, 100, 99
See application file for complete search history.

(56) References Cited

U.S. PATENT DOCUMENTS

| | | | | |
|---|---|---|---|---|
| 5,516,049 | A * | 5/1996 | Zoncada | 241/34 |
| 7,284,715 | B2 | 10/2007 | Dziesinski et al. | |
| RE40,042 | E | 2/2008 | Chang | |
| 2007/0284462 | A1 | 12/2007 | Dziesinski et al. | |
| 2008/0011888 | A1 | 1/2008 | Dziesinski et al. | |
| 2008/0217447 | A1 | 9/2008 | Jeansonne et al. | |

* cited by examiner

*Primary Examiner* — Mark Rosenbaum
(74) *Attorney, Agent, or Firm* — Woodard Emhardt Moriarty McNett & Henry LLP

(57) ABSTRACT

A shredding machine having loading section including a radially mounted pusher rod for driving materials placed with the loading section toward the cutting device. The radially mounted pusher rod may be spring loaded so as to exert resilient force on the materials during a shredding operation. At the end of a cycle, powered control arm returns the pusher rod to its original position.

21 Claims, 7 Drawing Sheets

MATERIAL AND PACKAGING SHREDDING MACHINE

FIELD OF THE INVENTION

The present invention relates in general to devices for shredding various materials. More particularly, the present invention relates to a device for shredding materials and packaging.

BACKGROUND OF THE INVENTION

Shredding devices exist in the prior art in various sizes and designs for shredding materials from metal to paper. The majority of shredders outside of industrial and waste management applications are designed for shredding paper and other media to prevent the disclosure of confidential information. Many papers and materials, such as medical records, financial statements, billing summaries, etc. include confidential information. Additionally, many companies routinely handle papers and materials which have confidential information associated with their clients or patients on them. Conventional paper shredders are sufficient to destroy many of these materials; however, other materials such as hard plastic and/or bulky materials such as prescription medication containers and the like may also contain confidential information. Medical professionals are required to protect this confidential information under Federal laws, such as the Health Insurance Portability and Accountability Act (HIPAA). In order to do so for hard plastic and/or bulky materials the medical field has turned to shredding devices.

Several shredder designs, such as that of U.S. Pat. No. 7,284,715 to Dziesinski, are designed for meeting the needs of the medical field. However, these designs have several drawbacks in that they utilize either a linear powered ram or gravity to feed the materials to be shredded into the cutting device. A linear powered ram design typically require that the shredder extend above a downward chute in order to accommodate the ram in a downward orientation. This increases the height of the shredder device above the cutting section and requires a reduction in the amount of space within the housing which can be devoted to storing shredded materials. This is also often an undesirable consequence as physical space is often at a premium in a medical facility. The cost of the ram and its associated power/control system frequently raises the manufacturing cost of the shredder considerably. Alternatively, a gravity feed design alone is often ineffective to fully urge materials into the cutting device. A need for a compact and efficient shredding device capable of shredding containers and other packaging exists.

SUMMARY OF THE INVENTION

One embodiment of the present invention is a shredding device having a chute for receiving bulky or hard materials between an opening on the outer housing and a cutting device therein. The device optionally also includes a separate path for feeding paper-like materials to the cutting device. The shredding device includes a radially mounted pusher for driving the bulky or hard material to be shredded toward a cutting device to ensure that the material is completely shredded in an efficient manner.

According to a feature in some embodiments the pusher is resiliently biased to provide force in driving the material to be shredded toward the cutting device. The pusher is then returned under power to its initial position.

According to an alternate embodiment a shredding device having a chute between an opening on the outer housing and a cutting device therein is provided. The shredding device includes a pusher for driving the material to be shredded toward the cutting head to ensure that the material is completely shredded in an efficient manner. The pusher operates to drive the material toward the cutting head using mechanical potential energy, while a motor and linkage is used to return the pusher to its initial position.

According to another feature in some embodiments, the shredding device has first and second chutes between two openings on the outer housing respectively and a cutting device therein. A sensor is positioned between the cutting device and the first chute for providing a signal which repeats the shredding cycle in the event material to be shredded remains after a prior shredding cycle.

This summary is provided to introduce a selection of concepts in a simplified form that are described in further detail in the detailed description and drawings contained herein. This summary is not intended to identify key features or essential features of the claimed subject matter, nor is it intended to be used as an aid in determining the scope of the claimed subject matter. Yet other forms, embodiments, objects, advantages, benefits, features, and aspects of the present invention will become apparent from the detailed description and drawings contained herein.

DESCRIPTION OF PREFERRED EMBODIMENTS

Figure 1:
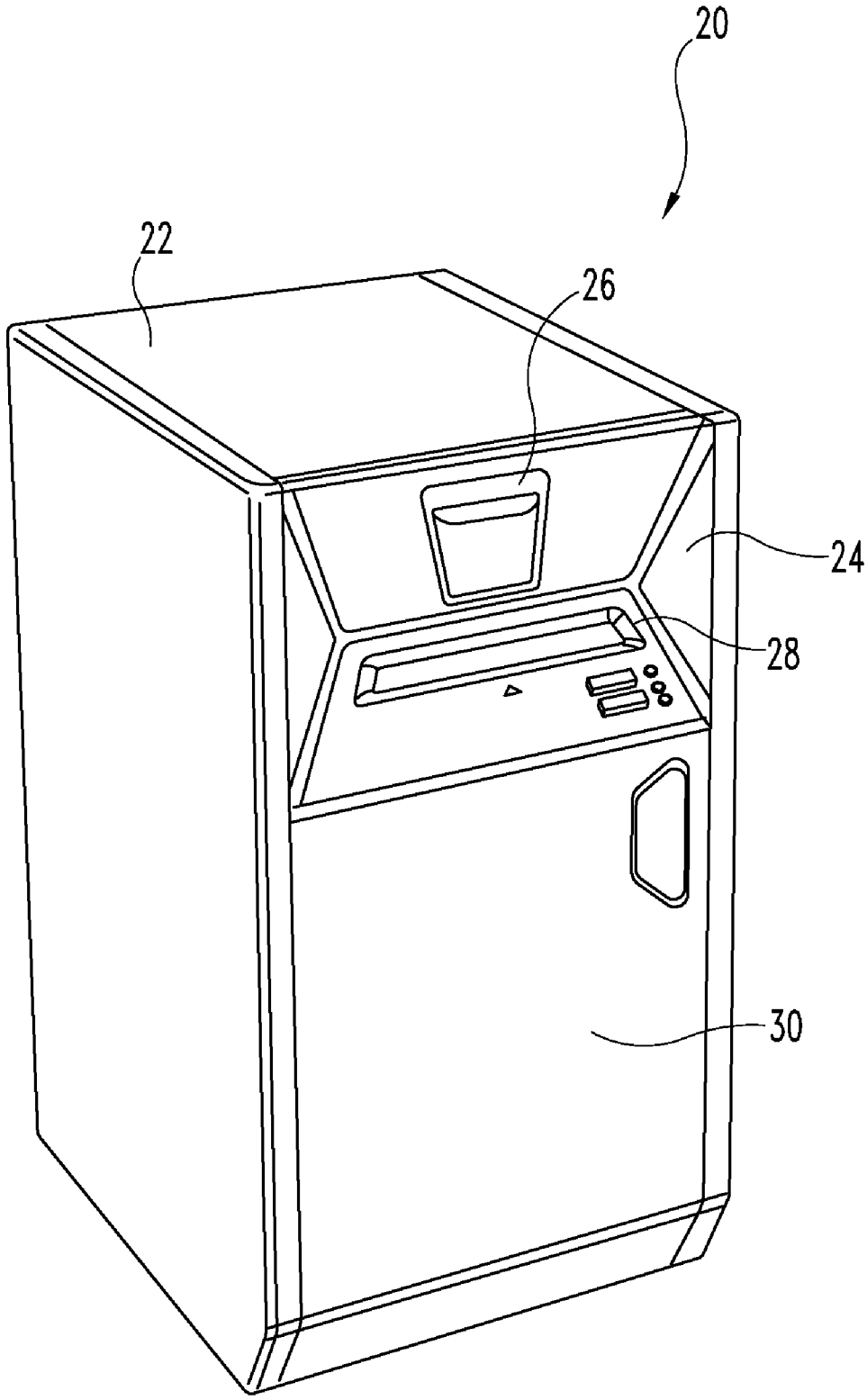
FIG. 1 is a perspective view of a shredding device according to one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended. Alterations and modifications in the illustrated device, and further applications of the principles of the invention as illustrated therein are herein contemplated as would normally occur to one skilled in the art to which the invention relates.

Referring to FIG. 1, a perspective view of a shredding device according to one embodiment of the present invention is shown. Shredding device 20 includes a substantially rectangular block housing 22 having a front face 24. In the embodiment shown, the housing is compact and suitable for placement under a countertop or shelf and measures approximately 18"×21"×35". In alternate forms, the housing may be of a greater or smaller dimension depending upon the placement desired and the particular shredding and storage capacities required. Preferably, housing 22 is constructed from a high strength composite material or metal, however, other types of material known to one of skill in the art may be utilized. Housing 22 is preferably generally divided into two separate compartments including an upper compartment for the mechanical components and a lower compartment for storing shredded materials, with a cutting device arranged between the two. Housing 22 optionally includes a sound damping/absorbing material on its internal surfaces to reduce audible noise during operation.

Viewing the external portion of housing 22, a first opening 26 and a second opening 28 are positioned on the upper portion of front face 24. In the illustrated embodiment, first opening 26 is shown positioned in a recessed portion of front face 24 and has an outward opening door covering the opening. In alternate forms, first opening 26 may have a sliding door, swinging door, or some of other type of closure or protective covering. Second opening 28 is configured as a slot suitable for receiving a number of pieces of sheet type material, such as standard office paper or the like. Preferably, second opening 28 is sized to allow at most the simultaneous insertion of the maximum number of sheets of paper that the internal cutting device can handle. In the illustrated embodiment, second opening 28 measures approximately 9" wide and is sized to permit the simultaneous insertion of up to 20 sheets of 20-lb. bond paper or comparable amounts of other sheet-type materials. In alternate forms, the second opening may be omitted to provide only the material shredding functionality offered by first opening 26.

An access door 30 is mounted to the lower portion of the front face 24 of housing 22. As shown in this embodiment, door 30 is hinged and can swing open outwardly to provide access to a removable bin inside which catches and stores the shredded material. In one preferred form, door 30 is secured to housing 22, such as by a keyed locking mechanism or the like, to prevent unauthorized access to the materials therein which may contain contaminants such as prescription medication residue or the like.

Figure 2:
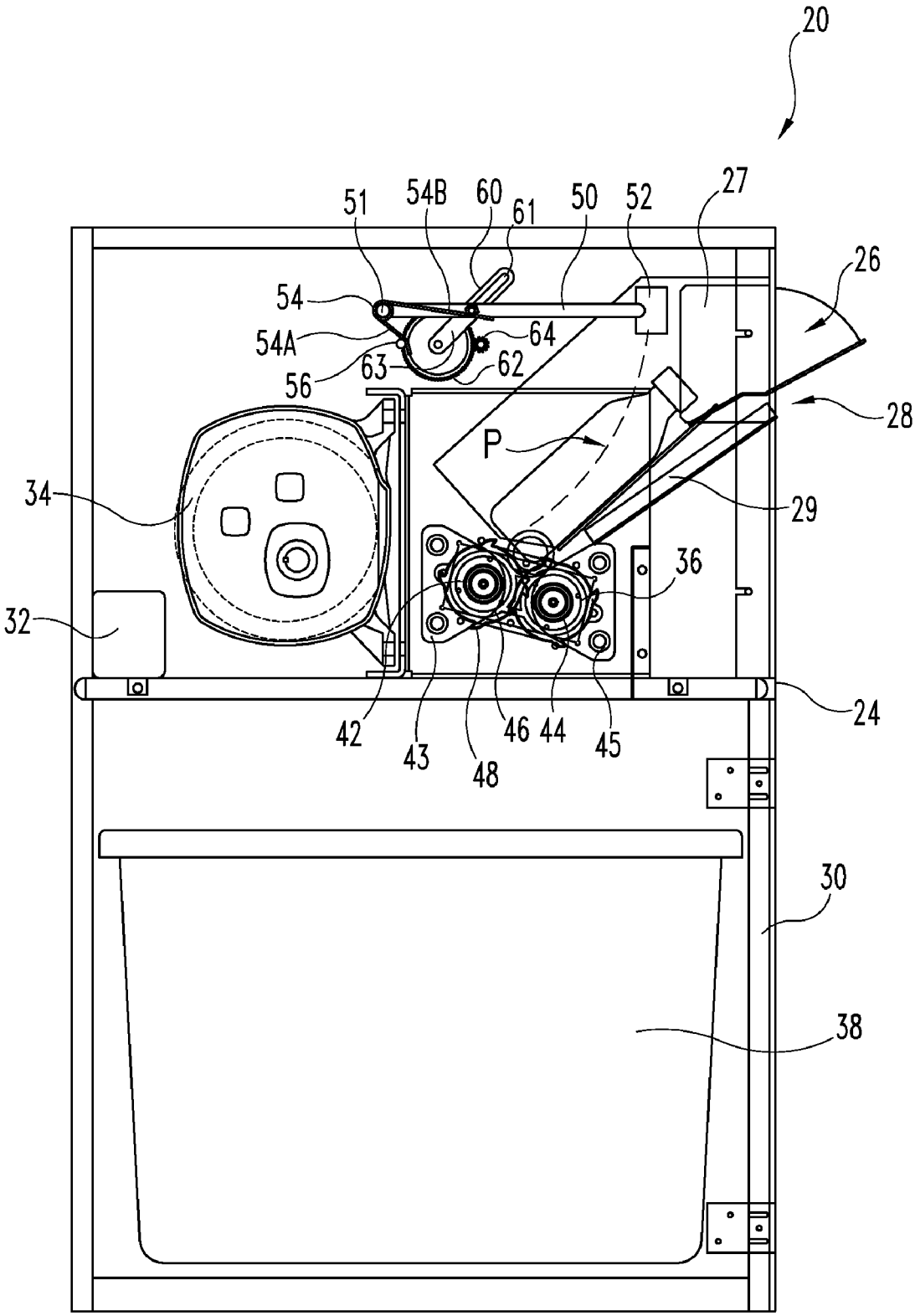
FIG. 2 is a left side interior view of the shredding device of FIG. 1.

Turning to FIG. 2, an interior side view of the shredding device 20 is shown. Shredding device 20 incorporates common shredder components including a power supply 32, a motor 34, cutting shafts and cutting elements forming device 36, and a removable bin 38. Power supply 32 is preferably a 110V AC powered linear power supply which converts the voltage from a standard wall outlet to the proper voltage required by the powered components of shredder device 20. In other forms, power supply 32 may be a power supply operating on a different voltage, such as 220V, or using alternate electrical power source, such as a battery.

Motor 34 is preferably an electrical motor suitable for driving the selected cutting device 36. The motor 34 is preferably coupled to the cutting device 36 utilizing a reducing gearing so as to provide increased torque to the cutting device 36 without high speed operation. Alternative methods of coupling motor 34 to cutting device 36 will be appreciated by one of skill in the art. Preferably, the motor 34 is capable of operating cutting device 36 in either direction so as to provide the desired shredding functions in normal operation or a temporary reversal if necessary to remove jammed material.

Removable bin 38 is illustrated within housing 22 below cutting device 36. Bin 38 collects the shredded material as it is expelled from cutting device 36 and stores it for subsequent removal. Optionally, bin 38 may receive a liner such as a bag for easy removal and disposal of the shredded material.

Also within housing 22 are first chute 27 and second chute 29. First chute 27 is accessible from outside housing 22 through first opening 26 and serves to direct materials placed within first opening 26 downward and into cutting device 36. Second chute 29 is accessible from outside housing 22 through second opening 28 and serves to direct sheet type materials placed within second opening 28 downward and into cutting device 36 for shredding.

Cutting device 36 as shown is positioned to accept material from both first chute 27 and second chute 29. Cutting device 36 is preferably a two-roll shredding device including shafts 42 and 44. Shafts 42 and 44 are supported near their ends by mounting plates 43 and 45 respectively. Mounted along shafts 42 and 44 are a plurality of cutting blades, such as for example cutting blade 46. Cutting blades preferably include a number of cutters, such as cutter 48. In the embodiment illustrated, these cutters are small sharp extrusions from the otherwise circular blade which operate in conjunction with the opposite shaft to draw in and shred the material it comes into contact with. It is preferred that cutters 46 are placed on shafts 42 and 44 so that the cutters are staggered and spaced, for example in a chevron pattern.

During a shredding cycle, shafts 42 and 44 are powered by motor 34 to rotate in opposite directions. In the illustrated embodiment, shaft 42 would rotate clockwise while shaft 44 would rotate counterclockwise in order to draw material into cutting device 36 and shred it between the cutters while expelling the shredded material below cutting device 36. It shall be appreciated by one of skill in the art that cutting device 36 may include two individual shredding units or a three roll shredding unit for creating separate paths for materials received through first chute 27 and second chute 29.

Figure 3:
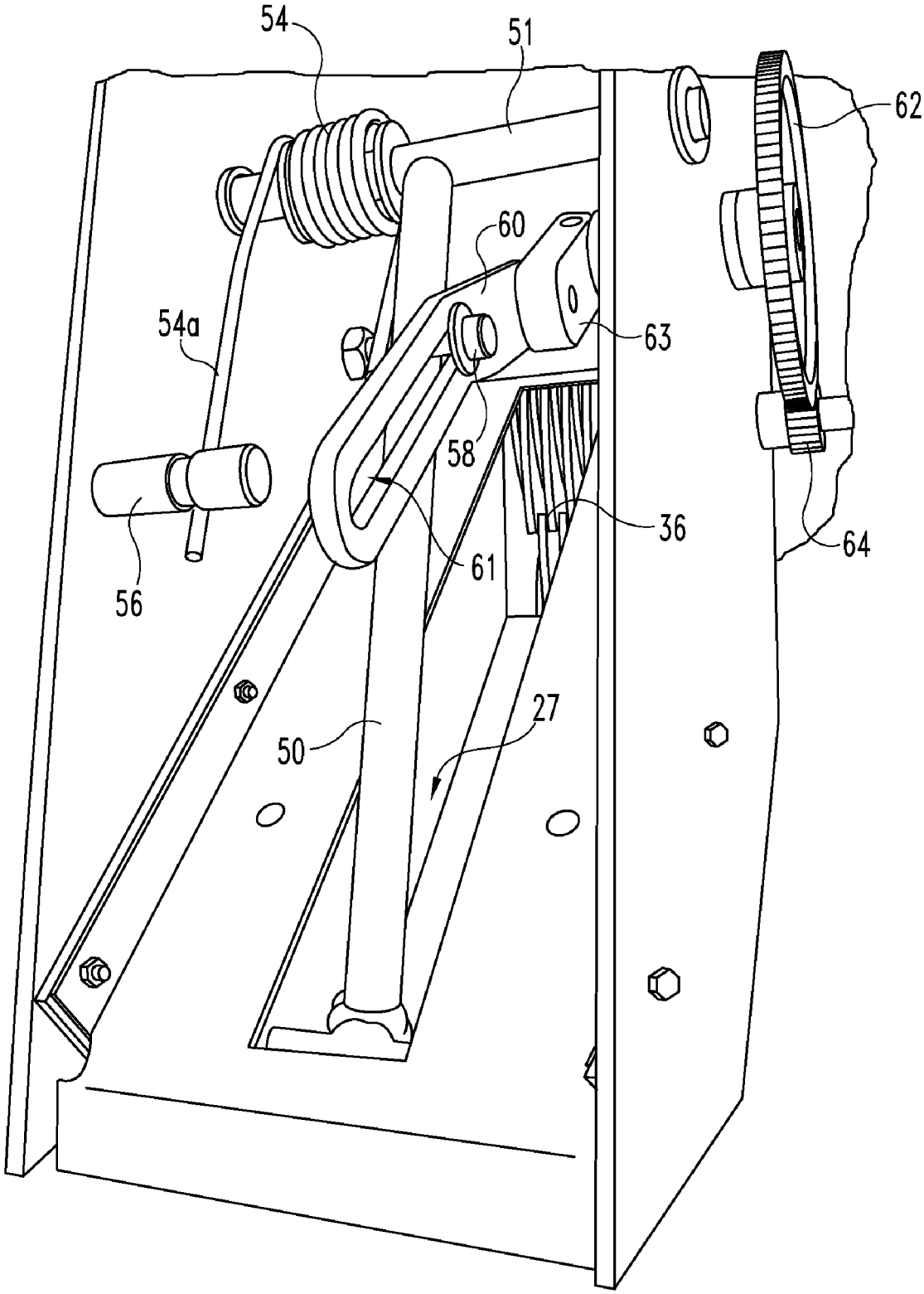
FIG. 3 is a partial perspective view illustrating in detail the pusher device in the upper portion of the shredding device of FIG. 1.
Figure 4:
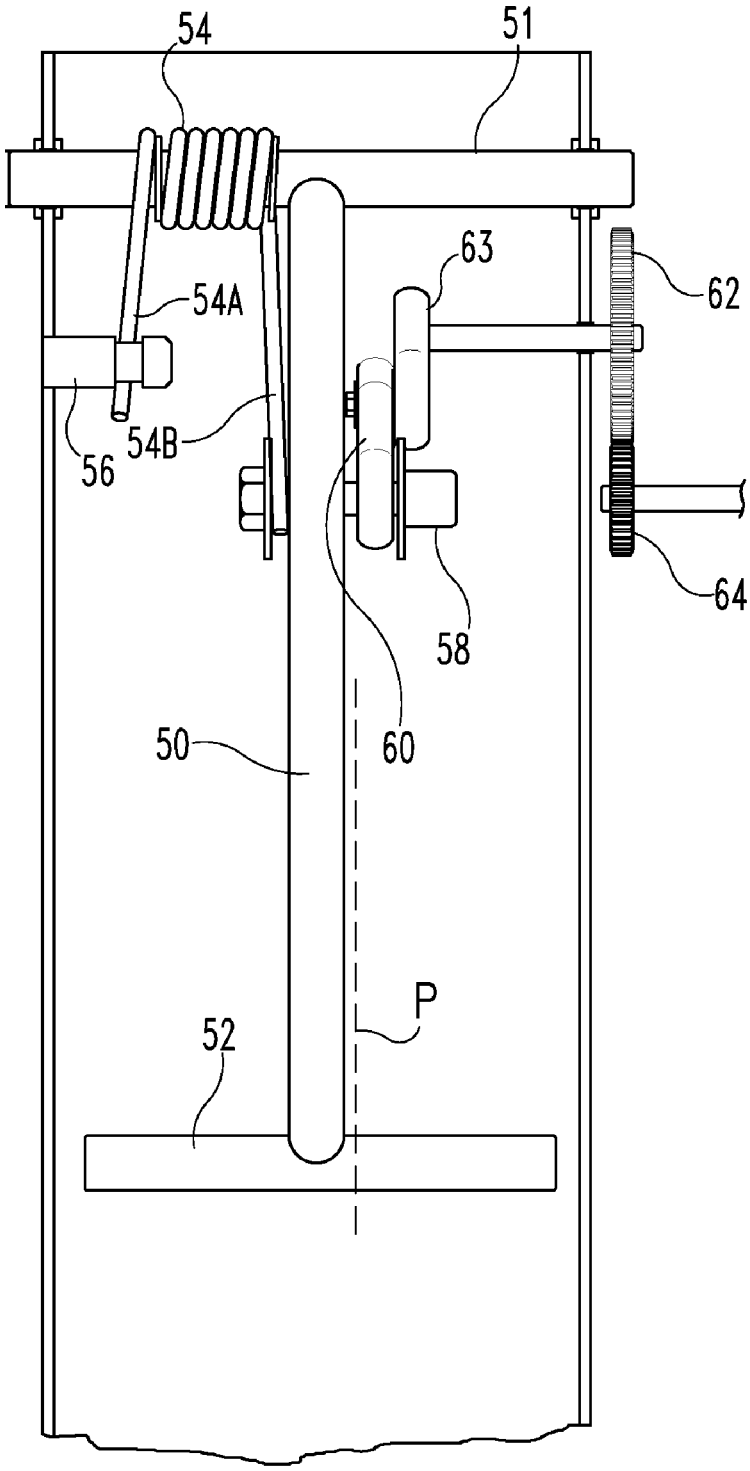
FIG. 4 is a simplified top view illustrating in detail the pusher device of the shredding device of FIG. 1 with the chute upper plate and cutting device not shown for ease of illustration.
Figure 5:
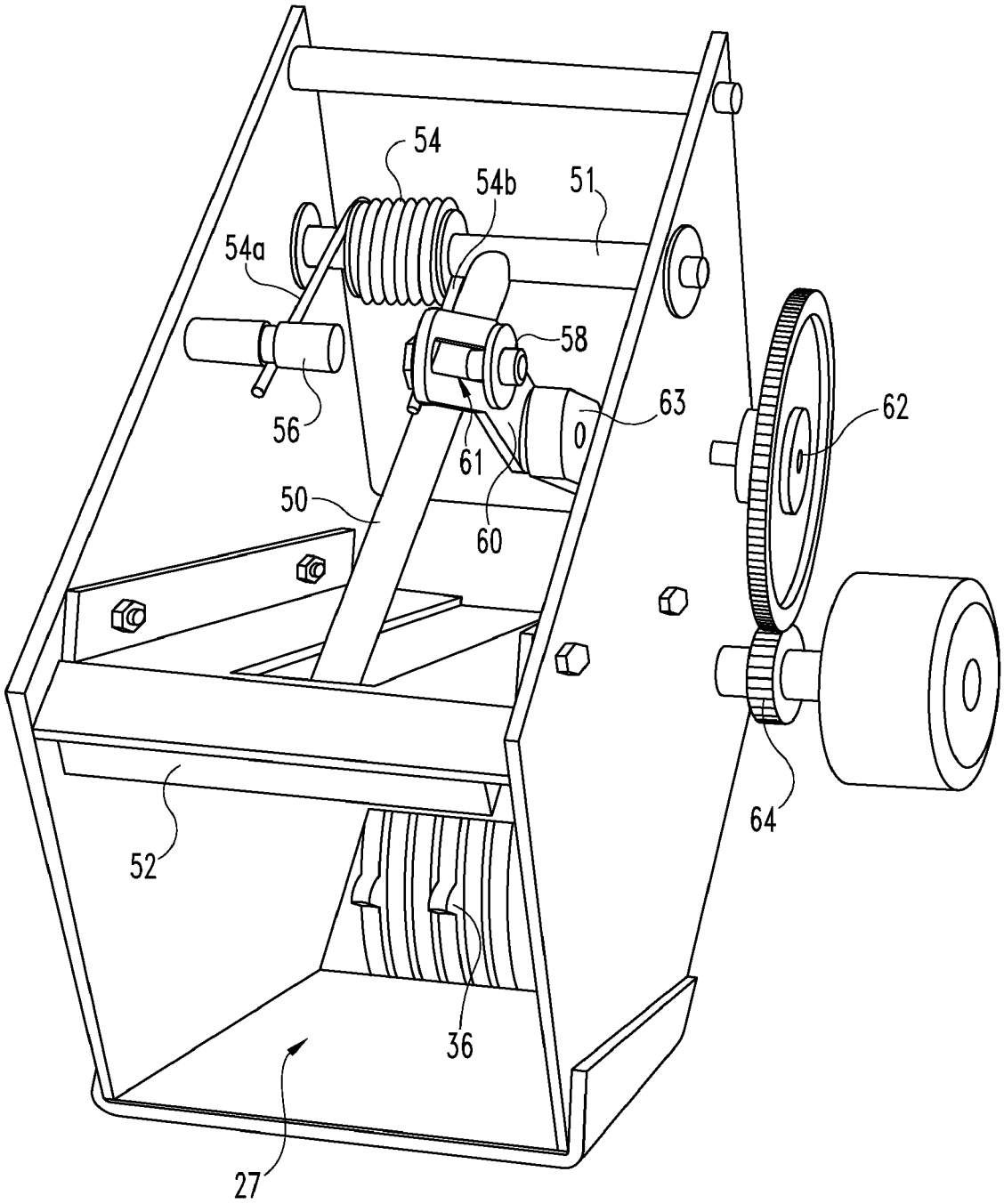
FIG. 5 is a second partial perspective view illustrating only the pusher device in the upper portion of the shredding device of FIG. 1

Referring to FIGS. 3-5, with continued reference to FIG. 2, the pusher mechanism of shredding device 20 will now be described. A pusher rod 50 is mounted within housing 22 and is arranged to provide assistance in forcing materials down first chute 27 into cutting device 36. Pusher rod 50 is formed from a rigid material and extends radially from axle 51. Axle 51 may be a fixed axle, a rotably mounted axle attached to or integrated with pusher rod 50, or otherwise such that pusher rod 50 rotates with or around the axle. Preferably, first axle 51 is mounted above said cutting device 36 and is arranged such that pusher rod 50 is perpendicular to the longitudinal axes of shafts 42 and 44 of cutting device 36.

A pusher head 52 is preferably positioned at the distal end of pusher rod 50. Pusher head 52 may be integrated into pusher rod 50 or attached thereto. Pusher head 52 is positioned within first chute 27 and is preferably sized to occupy a substantial portion, such as at least 75%, of the width of first chute 27. Pusher head 52 may be in the form of a cylinder, rectangular block, or otherwise to assist in feeding materials within first chute 27 to cutting device 36. Optionally, a rubber seal, brushes or a similar device (not shown for ease of reference) may be placed along the slotted area where pusher rod 50 enters first chute 27 to prevent debris from exiting first chute 27 during operation.

Pusher rod 50 is shown in FIG. 2 in an initial position. Pusher rod 50 is preferably resiliently biased to rotate downward, thus driving pusher head 52 toward cutting device 36 along a radial path P. In the illustrated embodiment, this is accomplished by mounting a spring 54 around axle 51 and restraining it at a straight end 54*a* using a fixed point, such as stationary rod 56, and engaging its other end 54*b* to the proximal end of pusher rod 50 or a portion of its control tab described herein. It shall be appreciated by one of skill in the art that other forms of biasing pusher rod 50, such as other methods of storing mechanical potential energy or the like may be utilized. As used herein stored mechanical potential energy excludes simple gravitational potential energy.

The movement of pusher rod 50 and pusher head 52 is partially controlled by control arm 60. Control arm 60 is pivotally linked at a proximal end to lever arm 63 which extends from rotating axle 62 in a fixed orientation. Control arm 60 is pivotally linked to lever arm 63 at a pivot point radially offset from axle 62 so that arm 63 functions as a lever arm between the axle and the pivot point. Axle 62 is rotated by a sprocket 64 which is driven by motor 34. Control arm 60 has a control slot 61 at its distal end.

Pusher rod 50 is preferably linked to control slot 61 at a point spaced along the length of pusher rod 50 from axle 51. In one example, this is done using control tab 58 which extends horizontally from rod 50, so that control tab 58 pivotally rides in control slot 61.

Figure 6:
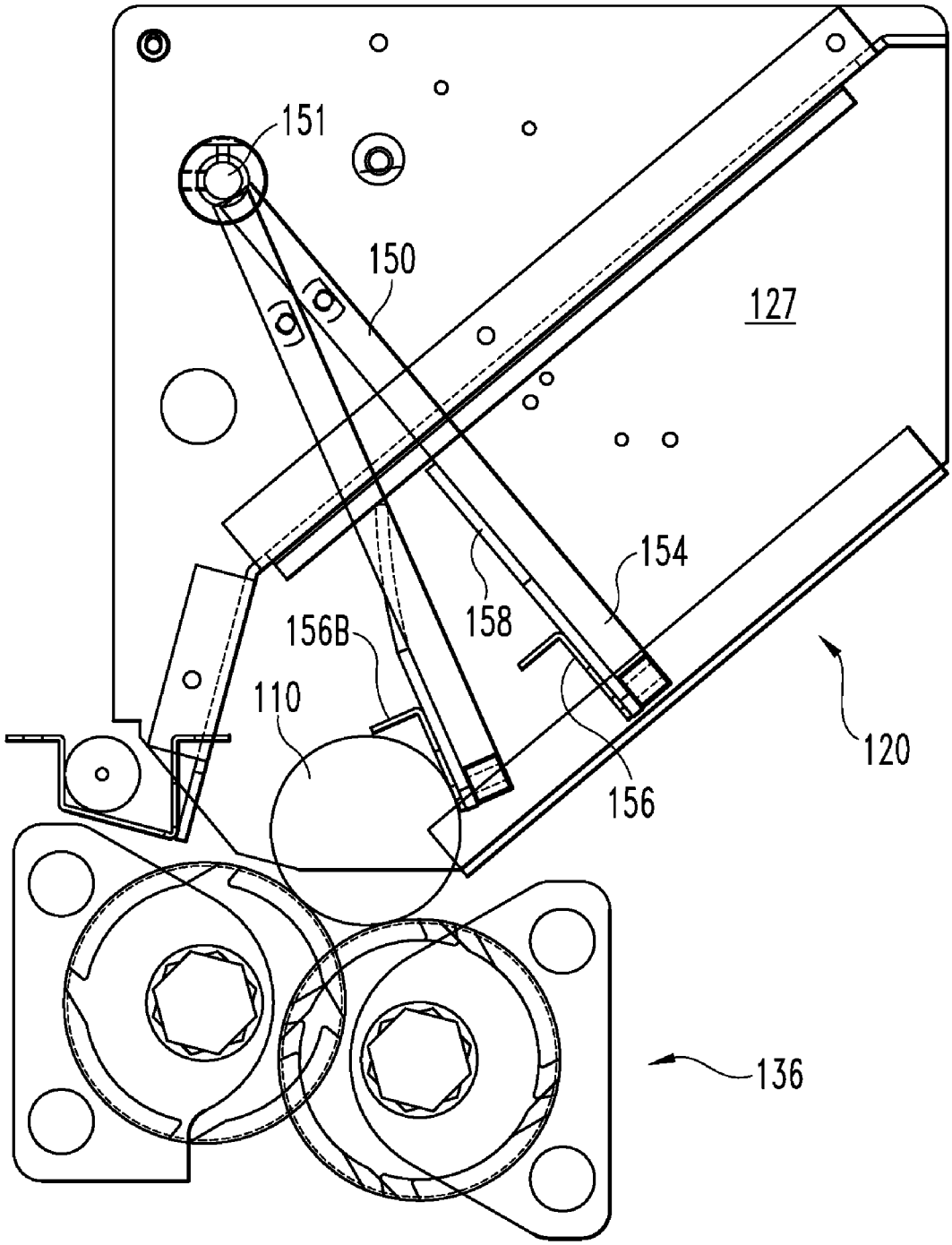
FIG. 6 is a side interior view of an alternate embodiment of the shredding device of FIG. 1.

Turning to FIG. 6, an interior side view of an alternate embodiment of a shredding device 120 is shown. Shredding device 120 is substantially similar in overall structure and operation to shredding device 20. In device 120, a pusher rod 150 is arranged to provide assistance in forcing material, such as a bottle 110, down chute 127 into cutting device 136. Pusher rod 150 extends radially from axle 151. FIG. 6 illustrates pusher rod 150 in one position during the cycle which is substantially perpendicular to chute 127, and also illustrates pusher rod 150 in an advanced position urging bottle 110 into the cutting device 136.

Figure 7A:
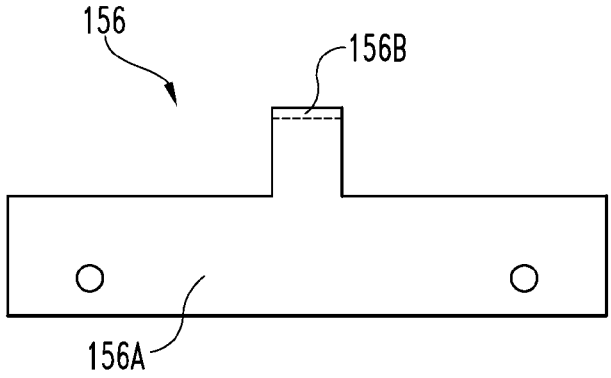
FIGS. 7A-C are views of a deflector bracket used in the embodiment shown in FIG. 6.
Figure 7B:
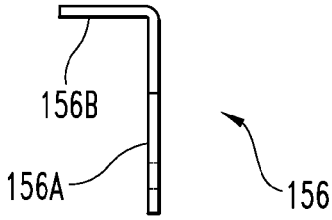
Figure 7C:
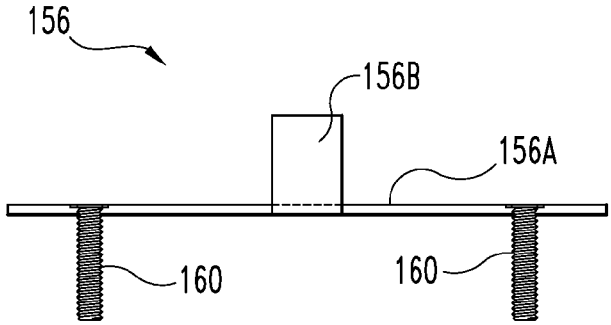

In the embodiment shown in FIG. 6, an optional deflector bracket 156 is mounted adjacent the lower end of pusher rod 150, for example using fasteners such as screws or bolts 160. Views of one embodiment of bracket 156 are shown in FIGS. 7A-7C. Bracket 156 preferably includes a forward face 156A extending substantially across the width of chute 127. In certain embodiments, bracket 156 further includes a tab 156B extending forward from the bracket and pusher arm, for example at approximately a 90 degree angle. Tab 156B has a leading edge and lower face which preferably engage a portion of bottle 100 or other materials being shredded along an upper portion or at a higher location than face 156A engages the bottle, such that tab 156B urges the bottle 110 downward and into engagement with the cutting device 136, while minimizing the ability of the bottle 110 or debris to bounce or float above the cutting device without being engaged. Tab 156B may extend completely or only partially across the width of chute 127.

Optionally, pusher rod 150 further includes a backstop panel or gasket 158, for example mounted between the pusher rod 150 and deflector bracket 156. Backstop 158 is preferably substantially perpendicular to chute 127 preferably has a cross-section which substantially fills the cross-section of chute 127 as pusher rod 127 moves within the chute. Backstop 158 preferably minimizes and prevents material, such as bottle 110 or related debris or dust, from travelling or rebounding upward in chute 127 during the shredding process. Backstop 158 optionally has a flexible upper portion, which may contact the upper surface of chute 127 and which may deflect slightly forward or rearward to avoid inhibiting movement of pusher rod 156 during movement of pusher rod 150 into rearward or forward locations.

The operation of a shredding cycle will now be described in detail. Shredding device 20 will be described in detail; shredding device 120 operates in a similar manner. It shall be appreciated that the shredding operation may be activated by a user indication, such as depressing a start button, or by an automatic start upon the closing of door 26 coupled with a detection that material to be shredded is present. Other start methods will be appreciated by one of skill in the art. A shredding cycle begins with motor 34 being powered on which activates cutting device 36 such that shafts 42 and 44 rotate. In addition, sprocket 64 is driven by motor 34 to rotate axle 62 clockwise which rotates control arm 60 inward or downward. A single shredding cycle and accompanying movement of pusher rod 50 is completed in a 360 degree rotation of axle 62 and lever arm 63.

During the downward cycle, control arm 60 is drawn downward and inward. The lower end of control slot 61 is lowered and allows pusher rod 50 to rotate downward (clockwise as shown in FIG. 3). Pusher head 52 moves from adjacent the first opening 26 down first chute 27 along a radial path P toward cutting device 36, preferably under power not applied by control arm 60. Pusher rod 50 is limited from rotating by the location of the lower end of control slot 61. Preferably at its lowest position, control arm 60 prevents pusher head 52 from contacting cutting device 36.

During the downward cycle, pusher head 52 typically encounters the material to be shredded and may encounter resistance as the material is fed into the cutting device. This resistance force is absorbed by the spring 53 which resiliently allows the pusher rod 50 to slow or stop in its radial path while still applying downward pressure to the material toward the cutting device. If the pusher rod 50 slows or stops in its path during the downward cycle, control arm 60 and slot 61 will continued to advance and control tab 58 will travel upward, relatively, within control slot 61 thereby preventing feedback force from being transferred from the pusher rod 50 to motor 34. Control slot 61 is preferably sized in length to permit pusher rod 50 to remain in its initial position throughout a shredding cycle if needed.

Once axle 62 and lever arm 63 have completed a first portion, in this case half of the cycle, in a second portion of the cycle lever arm 63 begins advancing, forcing control arm 60 to begin advancing upward and outward. As control arm 63 advances, the lower end of control slot 61 applies power to pusher rod 50, for example by pushing upward on control tab 58 to overcome the bias force of spring 54. As a result, pusher head 52 returns to its position adjacent the top of first chute 27, allowing additional materials to be loaded through first opening 26 for a subsequent shredding cycle.

Example advantages offered by the radially mounted pusher rod include space saving features which make use of the depth of the shredding device without a need for addition space above the cutting section to house a linear ram or the like. Additional advantages are offered in that a pusher which pushes materials into a cutting device using stored mechanical potential energy, such as from a spring, provides resilient force to limit feedback as the shredder shreds the materials. Power is only applied to return the pusher to its initial position.

An electronic controller is operable to activate cutting device 36 and rotate control arm 60 to progress through a shredding cycle as described herein. The electronic controller is optionally manually operable to activate the shredding cycle upon receiving an electronic indication from a user, such as through a switch or button, or may automatically start a cycle after material is detected. The shredding in the second path can be separately manually or automatically activated upon the insertion of paper-like materials into second opening 28.

A further embodiment of shredding device 20 includes an electronic sensor positioned within first chute 27 adjacent to cutting device 36. In one option, in the event the electronic sensor detects material in the first chute 27 after a first shredding cycle, the controller may be programmed to automatically repeat the shredding cycle. Other options include a door position sensor which cuts power to the cutting device when open. Other safety features may be integrated within the shredder as would be readily appreciated by one of skill in the art.

While the invention has been illustrated and described in detail in the drawings and foregoing description, the same is to be considered as illustrative and not restrictive in character. Only the preferred embodiment, and certain alternative embodiments deemed useful for further illuminating the preferred embodiment, have been shown and described. All changes and modifications that come within the spirit of the invention are desired to be protected.

What is claimed is:

1. A material shredding device comprising:

a housing having at least a first opening and a first chute for receiving materials to be shredded;

a cutting device having a motor and at least two cutting shafts mounted within said housing, said motor configured to selectively rotate said cutting shafts;

wherein said first chute leads from said first opening to said cutting device;

a pusher rod radially extending from a first axle to a distal end within said first chute; and a pusher head arranged at said distal end of said pusher rod, wherein said pusher rod is biased with a spring to rotate downward, so that said pusher rod is operable to move from a substantially horizontal position adjacent said first opening towards said cutting device in a radial path within said first chute to drive material to be shredded into said cutting device.

2. The device of claim 1, wherein said first axle is mounted above said cutting device.

3. The device of claim 2, wherein the longitudinal axis of said pusher rod is perpendicular to the axis of rotation of said cutting shafts.

4. The device of claim 3, wherein the width of said pusher head is at least 75% of the width of said first chute.

5. The device of claim 1 further comprising:

a second opening within said housing for receiving sheet-type materials to be shredded; and a second chute leading from said second opening to said cutting device.

6. The device of claim 5, wherein said pusher rod is spring loaded to rotate downward in said first chute toward said cutting device.

7. The device of claim 1, comprising a control arm linked to said pusher rod at a point spaced from said first axle along the length of said pusher rod, wherein said control arm is movable in a powered cycle wherein said control arm allows said pusher rod and pusher head to move toward said cutting device without using power applied by said control arm during a first portion of said cycle, and wherein said control arm applies power to said pusher rod to move said pusher head away from said cutting device during a second portion of said cycle.

8. The device of claim 7 further comprising:

a control tab extending from said pusher rod at a point spaced along said pusher rod from said first axle; and wherein said control tab rides within a slot defined by said control arm to form the link from said pusher rod to said control arm, wherein said slot allows said pusher arm to move towards said cutting device during the first portion of said cycle and wherein an end of said slot operates on said control tab to move said pusher rod away from said cutting device in the second portion of said cycle.

9. The device of claim 8, wherein said control arm is pivotally engaged to a lever arm extending from a second axle within said housing at a point radially offset from said second axle.

10. The device of claim 8, wherein said first axle is mounted above said cutting device.

11. The device of claim 10, wherein the longitudinal axis of said pusher rod is perpendicular to the axis of rotation of said cutting shafts.

12. The device of claim 11, wherein the width of said pusher head is at least 75% of the width of said first chute.

13. The device of claim 12, wherein said pusher rod is biased with a spring to rotate downward in said first chute toward said cutting device.

14. A packaging shredding device comprising:

a housing having a first opening for receiving bulky materials to be shredded;

a cutting device having a motor and at least two cutting shafts mounted within said housing, said cutting shafts operable to controllably rotate;

at least a first chute leading from said first opening to said cutting device;

a pusher mounted substantially horizontally within said first chute, said pusher resiliently biased to travel from an initial position adjacent said first opening toward said cutting device; and a motor linked to said pusher and operable to return said pusher to said initial position.

15. The device of claim 14, wherein the pusher is biased within said first chute toward said cutting device by a spring.

16. The device of claim 14, wherein said pusher follows a radial path from said initial position toward said cutting device.

17. The device of claim 14 further comprising:

a second opening for receiving sheet-type materials to be shredded; and a second chute leading from said second opening to said cutting device.

18. A packaging shredding device comprising:

a housing having a first opening for receiving bulky materials to be shredded;

a cutting device having a motor and at least two cutting shafts mounted within said housing, said motor configured to selectively rotate said cutting shafts;

a first chute leading from said first opening to said cutting device;

a pusher rod radially mounted within said housing;

a pusher head arranged at the distal end of said pusher rod; and a control arm having a slot, wherein said pusher rod is linked to said slot at a point along the length of said pusher rod, wherein said control arm is moveable in a powered cycle to allow said pusher head to move under power not applied by said control arm towards said cutting device during the first half of said cycle and wherein said control arm applies power on said pusher rod to move said pusher head away from said cutting device during the second half of said cycle.

19. The device of claim 18 further comprising a sensor which detects the presence of material within said first chute approximate the end of a first cycle and sends a signal to a controller to activate a second cycle if material is present at the end of the first cycle.

20. The device of claim 18, wherein the pusher is resiliently biased within said first chute toward said cutting device by a spring.

21. The device of claim 18, wherein said control arm is pivotally linked to a lever arm extending from a powered axle.

* * * * *